United States Patent [19]

Seiler

[11] Patent Number: 4,583,310

[45] Date of Patent: Apr. 22, 1986

[54] SUPPORT DEVICE

[76] Inventor: Donald I. Seiler, P.O. Box 56259, Pinegowrie, Randburg, South Africa, 2123

[21] Appl. No.: 603,390

[22] Filed: Apr. 24, 1984

[30] Foreign Application Priority Data

Aug. 23, 1983 [ZA] South Africa ..... 83/6209

[51] Int. Cl.[4] ..... G09F 21/04

[52] U.S. Cl. ..... 40/592; 40/591; 116/28 R; 116/173

[58] Field of Search ..... 40/592, 591, 617, 610; 116/28 R, 173

[56] References Cited

U.S. PATENT DOCUMENTS

| | | | |
|---|---|---|---|
| 2,534,117 | 12/1950 | Flick | 40/591 |
| 3,036,545 | 5/1962 | Legg | 116/28 R |
| 3,525,461 | 8/1970 | Bronson | 40/592 |
| 3,762,360 | 10/1973 | Hawes | 40/591 |
| 4,026,595 | 5/1977 | Jacks | 40/592 |
| 4,152,854 | 5/1979 | Berry, Jr. et al. | 40/592 |
| 4,163,426 | 8/1979 | O'Neill | 40/591 |
| 4,259,660 | 3/1981 | Oliver | 40/592 |
| 4,375,134 | 3/1983 | Sheetz | 40/591 |

FOREIGN PATENT DOCUMENTS

| | | | |
|---|---|---|---|
| 2249497 | 4/1974 | Fed. Rep. of Germany | 40/592 |
| 2352312 | 4/1975 | Fed. Rep. of Germany | 40/592 |
| 2611922 | 9/1977 | Fed. Rep. of Germany | 40/592 |

*Primary Examiner*—Gene Mancene
*Assistant Examiner*—James Hakomaki

[57] ABSTRACT

A device for supporting a display board above a vehicle. The device includes a channel shaped formation which is sandwiched between an upper edge of a side window of the vehicle and the window surround and a spigot which is pivotal relatively to the formation and which is insertable into a downwardly facing socket at one side of the display board. Two of the devices are used to support the board, the devices being positioned at opposed sides of the board.

7 Claims, 2 Drawing Figures

SUPPORT DEVICE

BACKGROUND OF THE INVENTION

This invention relates generally to a support device for use in engaging or attaching material or objects to a vehicle and, more particularly, this invention relates to apparatus which is suited for displaying information on a vehicle, for example sales information relating to the vehicle.

It is customary for motor dealers to attach boards bearing sales information to vehicles which are offered for sale. It is necessary for the boards to be adequately secured to the vehicles to prevent their inadvertent dislodgement, particularly in open car lots, for such movement of the boards is annoying and can lead to the vehicles being damaged.

Apart from this application display boards are used for advertising purposes and to present information on matters quite unrelated to the vehicles to which they are secured.

Such display boards are usually secured to the vehicles by engagement of suitable clamping devices with the vehicles' gutters. In other instances, for example when the vehicle in question is a van, display boards are attached directly to the sides of the van. Descriptions of arrangements of this kind are to be found in the specifications of U.K. Pat. Nos. 672551, 1134725, 1418415 and 2106297, and of U.S. Pat. No. 4,084,338.

These devices are in many instances satisfactory but a recent development in the automobile industry has been the design of vehicles without side gutters and this precludes the use of at least some of the earlier devices.

SUMMARY OF THE INVENTION

It is an object of the present invention to provide a support device which is suitable for use with display apparatus of the kind described and which may readily be adapted for most vehicles.

The invention provides a support device which includes a first member which is engageable with a side window of a vehicle, and a second member which is connected to the first member and which in use at least partly supports display means located outside the vehicle.

Preferably the first member includes a channel-shaped formation which is engageable with an upper edge of the side window so that, when the window is raised, the formation is sandwiched between the window and a window surround.

The second member may be pivotally connected to the first member.

The second member may be connectable to the first member at a position selected from a plurality of positions.

The second member may include a spigot which may be slightly tapered. At least the spigot may be flexible.

The second member may be made at least partly from a reinforced plastics material. Preferably the first member is made from a similar material.

The spigot may be insertable into a socket which is complementally tapered and which is sized so that the spigot and socket are frictionally engaged with each other. The spigot may in use extend upwardly and the socket may face downwardly.

The spigot and socket may be of circular cross-section so that the spigot is rotatable in the socket. If necessary, however, the spigot and socket could be shaped to prevent relative rotation.

The socket may form a first limb of an elbow. A second limb of the elbow may be adapted to engage the display means.

In a preferred form of the invention the second limb of the elbow is slidably locatable in a channel member of the display means, preferably with a frictional fit.

The channel member may include formations which are adapted to engage with a display panel.

The invention also provides display apparatus which includes display means and at least two support devices of the type described located at opposing sides of the display means respectively, the devices being so arranged that the display means is locatable above the vehicle with the first members being respectively engaged with opposed side windows of the vehicle.

The display means may include a frame which is adapted to receive a display board or material on or in the frame. The frame may include a lower member which is engageable with the said second limbs of the elbows of the two support devices.

The invention also provides a method of securing a display board to a vehicle which includes the steps of attaching two support devices, at spaced locations, to the board, and engaging each support device with a respective side window of the vehicle with the board located above the vehicle roof and supported by the devices.

Each support device may be engaged with the respective side window by clamping a portion of the support device between the window and a window surround.

BRIEF DESCRIPTION OF THE DRAWINGS

The invention is further described by way of example with reference to the accompanying drawings in which.

DESCRIPTION OF PREFERRED EMBODIMENT

Figures 1, 2:
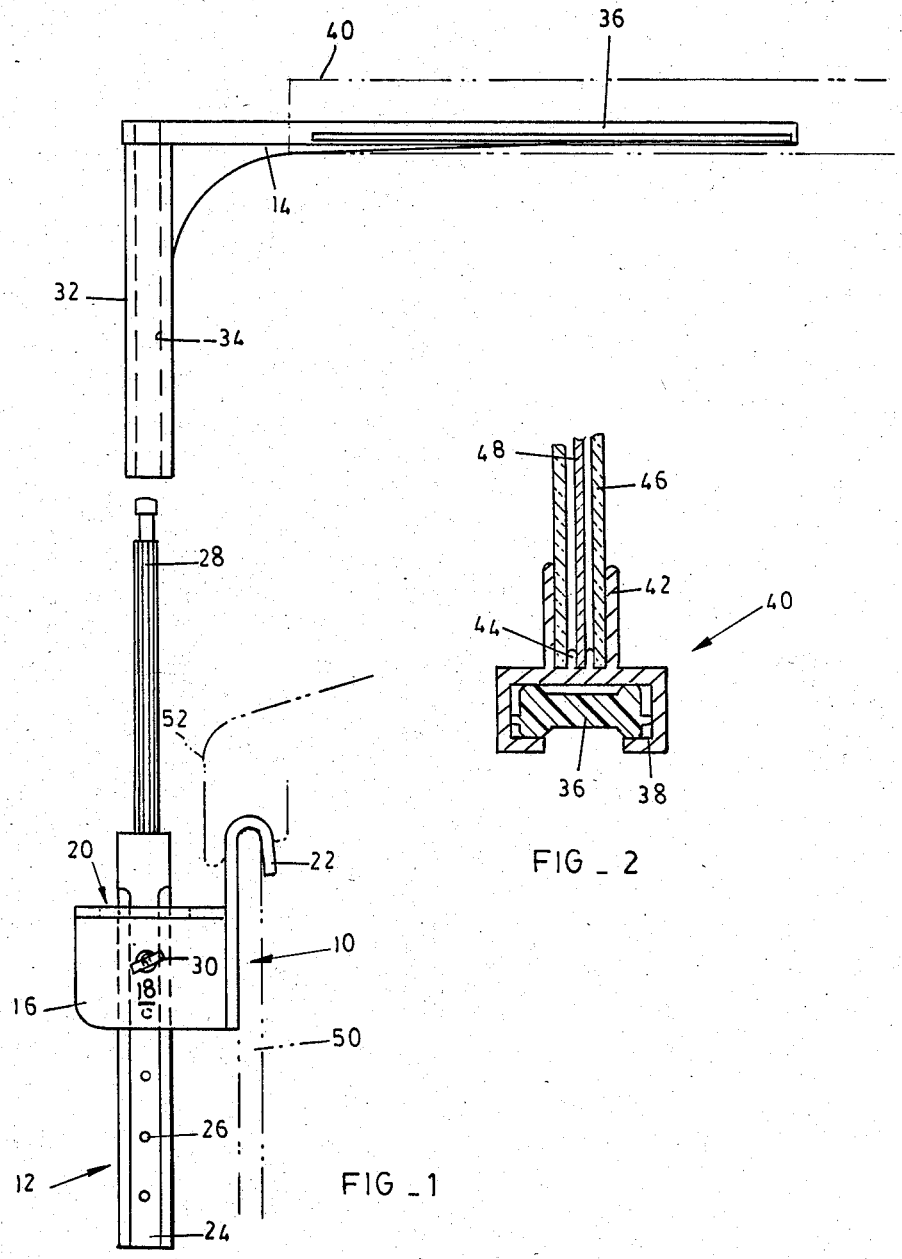
FIG. 1 illustrates the use of a support device according to the invention for supporting a display board above a vehicle.
FIG. 2 is a cross-sectional view of portion of the device shown in FIG. 1 illustrating the engagement thereof with a frame member of the display board.

FIG. 1 illustrates a support device according to the invention which includes a first member 10, and a second member 12 with an elbow 14.

The first member 10 includes a body portion 16 with side walls 18 which bound a vertically aligned passage 20, and a hook—or channel-shaped member 22.

The second member 12 includes a lower section 24 in which are formed a number of spaced holes 26, and an upper tapered spigot 28.

The member 12 extends through the passage 20 and is pivotally secured to the first member 10 by means of a split pin or similar device 30 which is passed through a selected one of the holes 26 and through registering holes in the side walls 18 of the body portion 16.

The elbow 14 includes a first limb 32 in which is formed a socket 34, and a second limb 36 which extends at right angles from the first limb.

In this example of the invention the spigot 28 and socket 34 are complementally tapered and are of circular cross-section so that the spigot is rotatable in the socket. This permits the position of the elbow relatively to the two members to be angularly adjusted, in plan.

As shown in FIG. 2 the second limb 36 of the elbow is slidably engageable, with a friction fit, a lower channel 38 of a frame member 40. The frame member has an upper channel 42 with two spaced parallel locating formations 44 on the base of the channel. Transparent sheet material 46 can be inserted into the channel 42 on either side of the formations 44 and an information carrying sheet 48 can be inserted between the two transparent sheets in the locating formations 44.

FIG. 2 illustrates only one frame member 40. This frame member forms the lower edge of a rectangular frame with the other three sides of the frame being formed by components which include sections similar to that provided by the upper channel 42 and the inner formations 44. The four frame members are securable to each other in any suitable way so that a rigid frame work is provided which is engageable with the peripheries of the sheets 46 and 48. Preferably at least one vertical frame member is detachable from the remainder of the frame so that the sheet 48 can be changed when desired. This particular aspect is not important for an understanding of the invention and therefore is not further elaborated on.

The support device of the invention is used to locate a display board above a roof of a vehicle. Use is made of two of the devices of the invention which are engaged, opposing each other, with respective ends of the frame member 40. The frame member 40 is indicated in dotted outline in FIG. 1. The display apparatus is secured to a vehicle by winding down two side windows 50, either the two rear, or front windows, and then engaging the channel 22 of each member 10 with an upper edge of the respective window. Each window is then wound up so that the channel is clamped between the upper edge of the window and an adjacent window surround 52. This procedure firmly locates the display apparatus of the invention in position. The degree of security of attachment is high for a vehicle with the display apparatus may be driven at a substantial speed without danger of the apparatus being dislodged. In this connection it should be pointed out that the spigot 28 can be made from a reinforced plastics material so that it is flexible and can deflect as wind resistance increases. This minimises the possibility of damage or breakage or of the display apparatus being dislodged. Alternatively a more rigid support, of greater strength, may be formed by fabricating the spigot from steel, preferably stainless steel, and securing it to the lower section 24, or otherwise fabricating the entire second member 12 from a suitable material.

The pivotal interconnection of the members 10 and 12 means that the apparatus can be used with vehicles which have side windows 50 with varying angles to the vertical. The member 12 may be adjusted relatively to the member 10 when necessary by sliding the second limb 36 in the frame member 40. Similarly vehicles which are of different widths can be catered for by sliding the elbows along the frame member 40 towards or apart from each other as the case may be.

I claim:

1. A support device for use on a vehicle, said device including first and second members which are rotatably interconnected, the first member having a channel-shaped formation which is engageable with an upper edge of a side window of the vehicle so that, when the window is raised, the channel-shaped formation is sandwiched between the window and a window surround, the second member including a display mounting portion comprising a generally upwardly extending component which in use at least partly supports display means located outside the vehicle, the second member also including an adjusting portion which is pivotally mounted for rotatable movement relative to the first member only in a plane substantially perpendicular to the longitudinal axis of the vehicle to adjust the generally upwardly extending component to a substantially vertical orientation when the said side window is at an angle to the vertical, and means for selectively vertically positioning the second member with respect to the first member in said plane which is substantially perpendicular to the longitudinal axis of the vehicle.

2. Display apparatus which includes display means and, at each of two opposed locations of the display means, a support device according to claim 1, the support devices being arranged so that the display means is locatable above the vehicle with the first members being respectively engaged with opposed side windows of the vehicle.

3. Display apparatus according to claim 2 wherein the display means at each of the opposed locations includes a downwardly facing socket for telescopically receiving said display mounting portion.

4. Display apparatus according to claim 3 wherein the display means includes a channel member connected to two elbows which are slidably located in the channel member on opposed sides of the channel member, each elbow including the respective downwardly facing socket.

5. Display apparatus according to claim 2 wherein the display means includes a frame and a display board which is supported by the frame, said frame including means for releasable connection of said frame with said upwardly extending components.

6. Display apparatus according to claim 5 wherein the display board includes an information sheet which is located between two supporting sheets at least one of which is transparent.

7. A support device according to claim 1 wherein the means for selectively vertically positioning the second member with respect to the first member is for positioning in a plane perpendicular to said plane which is substantially perpendicular to the longitudinal axis of the vehicle.

* * * * *